United States Patent [19]

Tantardini

[11] 4,428,400

[45] Jan. 31, 1984

[54] ELECTRICALLY AND HYDRAULICALLY ACTUATED FLOW-DISTRIBUTING VALVE UNIT

[75] Inventor: Paolo Tantardini, Milan, Italy

[73] Assignee: ATOS Oleodinamica S.p.A., Milan, Italy

[21] Appl. No.: 345,723

[22] Filed: Feb. 4, 1982

Related U.S. Application Data

[63] Continuation of Ser. No. 122,802, Feb. 20, 1980, abandoned.

[30] Foreign Application Priority Data

Feb. 28, 1979 [IT] Italy ..... 20935/79[U]
Apr. 12, 1979 [IT] Italy ..... 21343/79[U]

[51] Int. Cl.[3] ..... F15B 13/043
[52] U.S. Cl. ..... 137/625.61; 137/596.13; 137/625.64; 137/625.68
[58] Field of Search ..... 137/625.61, 625.64, 137/625.68, 596.13; 251/139

[56] References Cited

U.S. PATENT DOCUMENTS

| | | | |
|---|---|---|---|
| 3,434,390 | 3/1969 | Weiss | 137/625.61 |
| 3,565,110 | 2/1971 | Hodgson | 137/625.68 |
| 3,861,644 | 1/1975 | Knape | 251/139 |
| 4,212,323 | 7/1980 | Qureshi | 137/625.61 |
| 4,215,723 | 8/1980 | Ichiryu et al. | 137/625.64 |

FOREIGN PATENT DOCUMENTS

| | | | |
|---|---|---|---|
| 151313 | 9/1920 | United Kingdom | 137/625.68 |

*Primary Examiner*—Gerald A. Michalsky
*Attorney, Agent, or Firm*—Diller, Ramik & Wight

[57] ABSTRACT

A flow-distributing valve unit which is actuated electrically and hydraulically is disclosed, the improvement consisting in a double-acting piston distributor reciprocable in a chamber to which fluid intake and fluid discharge conduits are connected, the fluid intake ducts having fixed throttling passageways whereas variable width passageways are provided for the fluid discharge ducts. The widths of the discharge passageways for the fluid are varied by electromagnetic controls. A flow-distributing valve is integral with the double-acting piston mechanism and is connected with a valve actuator which can either be manual or moved by a servomechanism.

6 Claims, 3 Drawing Figures

ELECTRICALLY AND HYDRAULICALLY ACTUATED FLOW-DISTRIBUTING VALVE UNIT

This application is a continuation of application Ser. No. 122,802, filed 2/20/80, now abandoned.

This invention relates to an electrically and hydraulically actuated flow-distributing valve unit which is proportionally regulated.

The electrically and hydraulically actuated valve units known heretofore are essentially composed by the valve proper and by an electrical and hydraulic actuator for such valve. The valve is essentially composed by a body in the interior of which a seating is formed for allowing a slider to glide therein: fluid flow passageways are opened through such a seating. The slider has an appropriate outline so as to make possible both mutually to connect the intake ducts and the fluid exploiting ducts as well as to cut off the incoming fluid thus preventing same to flow towards the exploitation ducts, as a function of the position of the slider in its own seating. The slider is driven by the electric and hydraulic actuator aforementioned. More exactly, the actuator is composed, in the linear motion type, by a piston which can slide in the interior of a cylindrical seating having its two end headers bored to allow the passage of the piston stems therethrough, either stem being connected to the valve slider in order to actuate the latter. The piston partitions the cylindrical seating into two chambers which are separated from each other and which can alternately be connected to a source of fluid under pressure, or to exhaust. The pressure differential between the two chambers, which originates the linear shift of the piston, is achieved by means of a separate electrical and hydraulic distribution member, which is, however, hydraulically connected to the chambers and is a further component part of the system. Such distribution member is driven by an electric-signal-generating component, which, in the most sophisticated embodiments, is fed back by a transducer for controlling the position or other parameters of the movement of the slider-actuating stem.

Valve units of the kind referred to above as disclosed by the conventional art are impaired by defects. In the first place, these units are composed by a fair number of component parts. This fact requires a considerable space for installing the unit and the assemblage is uneasy. Such component part requires a casing to shield it from the external agents. The connection between the several component parts imposes the use of mechanical, electrical and hydraulic connection lines which involve sizing and location problems which are not readily solved when designing such an installation. These units, moreover, are often characterized by long response times: these are due also to the lengths of the component-interconnection ducts, which limit the possibility of adjustment.

The principal object of the present invention is to overcome the defects indicated above which are present in the conventional art.

Such object is achieved by virtue of an electrically and hydraulically actuated flow-distributing valve units, which is characterized in that it comprises:

An electrical-hydraulic actuator comprised of a body in the interior of which a cylindrical seating is formed which is adapted to receive a tight sealing sliding piston which partitions the seating into two hydraulically separated chambers individually connected to intake and outlet ducts for a pressurized fluid, said intake ducts having fixed throttled passageways, said outlet ducts exhibiting throttled passageways of variable width, the degree of throttling being adjustable by virtue of electrically and magnetically actuated valve cores which restrict the flow and originate controlled pressure drops, said piston being extended at both ends into two stems, and a flow-distributing valve integrally connected to said actuator, said valve having a slider gliding therein and connected to either stem of said actuator.

Furthermore, to allow a regulation of the flow which is accurately proportional to the position of the valve slider and to prevent the slider (which has an appropriate outline and generates during its adjusting movements throttlings of variable width for the fluid flow passage area) from originating pressure drops between the intake duct and the fluid utilization duct, which are variable as a function of the width of the throttling so provided, the valve is preferably embodied by a body in the interior of which there is formed a cylindrical seat for having said slider gliding, said seat having formed therethrough flow passageways for a pressurized fluid which are connected to flow conduits for such fluid, in the interior of such slider there being formed at least an axial channel-shaped hollow space which communicates with:

at least a bore, radially passing through the slider wall and which, in alternate sequence consistently with the position of the slider, is either opened towards the port connected to utilization ducts, or is opened towards the port connected to the fluid discharge ducts, or remains in the shuttered position against the wall of said seat, a set of bores, spaced apart from said first named bore and passing radially through the slider wall and which are longitudinally arranged serially, and which, in alternate sequence consistently with the position of the slider, are either opened towards the port connected to the intake ducts, or towards the port connected to the fluid utilization ducts, or which remain in the position in which they are shuttered by the wall of said seat, at least a bore, spaced apart from the previously named ones, passing radially through the slider wall and which, in alternate sequence consistently with the slider position is either opened towards the connection port towards a pressural compensator, or remains in the position in which it is shuttered by the wall of said seat, nonreturn valve means being provided in said cavity for cutting off the fluid which comes from the intake duct towards the other conduits, latching means being provided at the slider ends for latching the actuators for said valve.

In order that the features of the invention might be better understood, a description of an exemplary embodiment thereof is given hereinafter by way of example only, the description being aided by the accompanying drawings, wherein.

Figure 1:
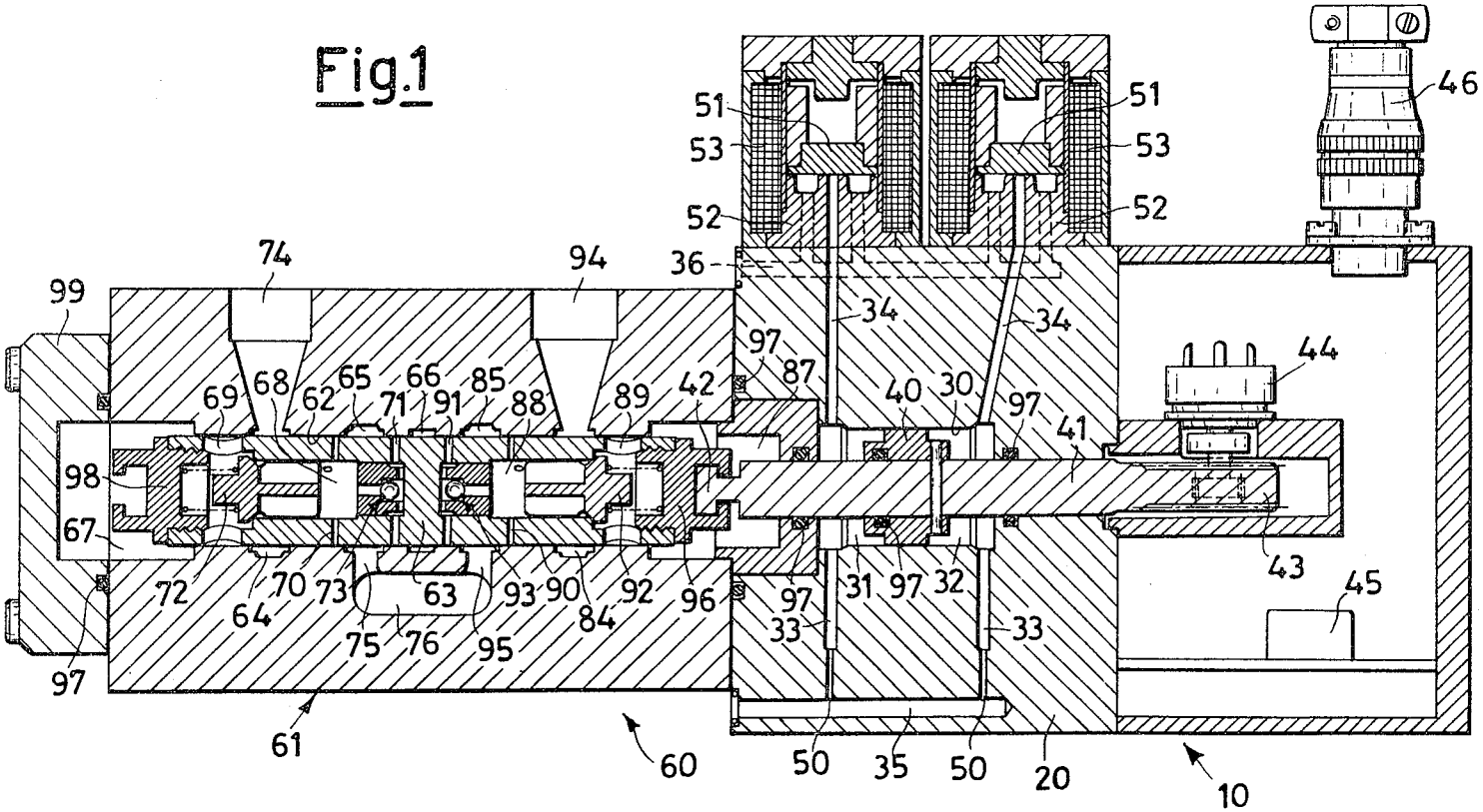
FIG. 1 is a lengthwise cross-sectional view of a valve unit constructed according to this invention.

By way of nonlimiting example, a flow-distributing valve unit is essentially composed by a flow-distributing valve 60 and an electrical and hydraulic actuator 10 for said valve 60 and integrally connected therewith. The actuator 10 is structurally composed by a compact body 20 in the interior of which a substantially cylindrical seat, 30, is formed, within which a piston 40 slides in a seal-tight manner. The piston 40 partitions the seat 30 into two chambers, 31 and 32, which communicate with intake ducts 33 and outlet ducts 34, respectively. The conduits 33 are connected to a fluid delivery duct 35 under pressure and the ducts 34 are connected to a duct 36 for discharging same fluid. Two fixed throttling passageways 50 are inserted between the duct 35 and the ducts 33. Between the ducts 34 and the duct 36 two variable-width throttling passages unnumbered, are inserted. Each variable-width throttling passage is originated by virtues of the translational shift of a core 51 which cuts off and throttles the fluid flow coming through the duct 34. The core 51 is urged towards a complementary core 52 by a magnetic force generated by a coil 53. Such magnetic force, as it is apparent, is proportional to the intensity of the current flowing through the coil 53. The piston 40 is concentrical with a cylindrical stem 41, one end, 42, of which is adapted to match a slider 63 of the valve 60: the other end 43 of 41 is connected by a rack-and-pinion assembly to a position-transducer 44. The transducer 44 feeds back a control station 45 which is electrically connected with the outside through a connector 46 and adapted to supply electric signals to the coilings 53. By so doing, an electric pulse applied to the coilings 53 and coming from the control station 45, the latter being influenced by the transducer 44 and by electric signals from outside, generates magnetic forces which move the cores 51. An appropriate proportioning of said forces causes pressure drops in the ducts which are such as to originate a pressure differential between the two chambers 31 and 32 so as to shift the piston 40 in its seating. The magnitude of such pressure differential influences the parameters of movement of the control stem 41 of the slider 63.

The flow-distributing valve 60 is composed by a compact body 61 in the interior of which there is formed a cylindrical seat 62 for the slider 63 therein. Through the seat 62 there are opened ports 64, 65, 66, 84, 85 for allowing a fluid to flow therethrough. The ports 64 and 84 are in communication, respectively, with fluid utilization conduits 74 and 94. The ports 65 and 85 communicate, respectively, with intake ducts 75 and 95 and these, in their turn, are connected to an inlet channel 76 for the fluid coming from a source of pressurized fluid (not shown).

Figure 2:
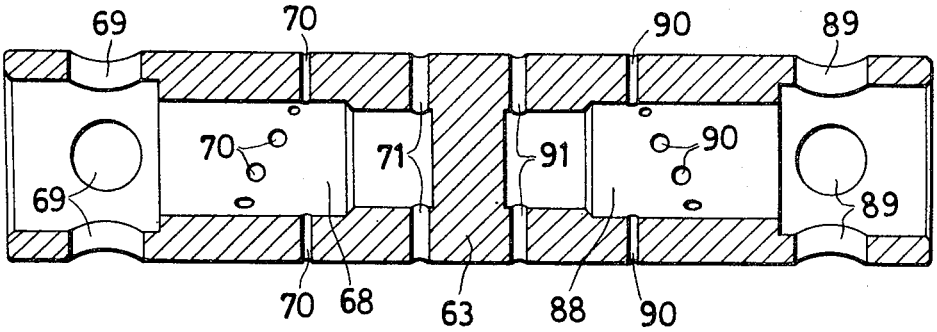
FIG. 2 is a lengthwise cross-sectional view of a detail of FIG. 1.
Figure 3:
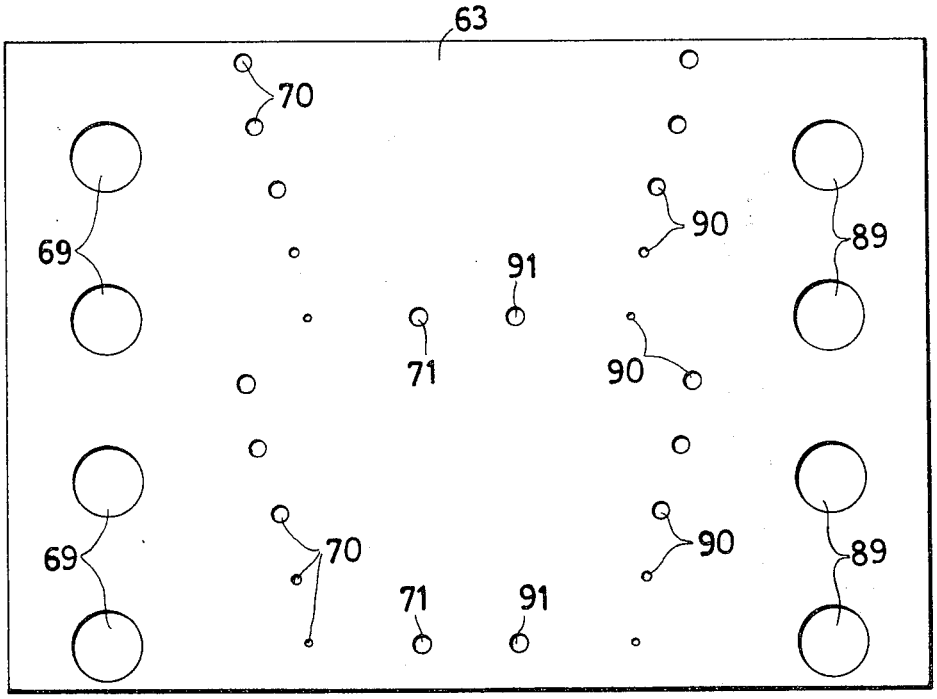
FIG. 3 is a plan view of the outersurface of the detail of FIG. 2.

The port 66 communicates with a pressure compensator of conventional make and not shown. The ends of the seat 62 are extended into closed chambers 67 and 87 which communicate with fluid discharge ducts not shown. In the interior of said slider 63 there are formed hollow spaces 68 and 88 in the form of axially running channels which communicate with bores 69, 70, 71, 89, 90 and 91 as best seen in FIG. 2. The area of the bores 69, 89 is generally double the sum of the area of the bores 70, 90, respectively. Said slider 63 offers seats for the valves 72 and 92 of the nonreturn type which cut off the fluid which comes, respectively, from the hollow space 68 to the bores 69, and from the hollow space 88 to the bores 89. The slider 63 also offers a seat to the nonreturn valves 73 and 93 which cut off the fluid coming, respectively, from the hollow space 68 to the bore 71 and from the hollow space 88 to the bore 91 to transfer the value of the pressure existing in the hollow spaces 68 and 88 to the pressure compensator.

In operation, an electric command to the coils 53, originated by the control station 45, the latter being influenced by the transducer 44 which indicates the position of the stem 41 and thus also that of the slider 63 and being also influenced by electric commands sent from the outside by an operator, generates, as aforesaid, magnetic forces driving the cores 51. If the magnitudes of these forces are properly adjusted so that the pressure of the fluid in the chamber 31 exceeds the pressure of the fluid in the chamber 32, the piston 40 and thus also the slider 63 are shifted towards the right with respect to the position as viewed in FIG. 1.

By so doing, the fluid under pressure coming from the conduit 75 flows through the port 65, the bores 70, the hollow space 68, the valve 72 as actuated by the hydraulic thrust of the fluid itself, and the bores 69, reaches at last the fluid utilization conduit 74. It is possible to achieve an accurate regulation of the fluid flowing towards the conduit 74, especially by virtue of the sequential presence of the bores 70, the opening of which towards the port 65 can be throttled by the position of the slider 63. A fraction of the fluid which flows into the hollow space 68 passes through the valve 73 (energized by the hydraulic fluid pressure) and through the port 66 to energize the pressure compensator: this in order to maintain a constant pressure drop which is limited for the valve 60 irrespective of the slider position and thus of the throttlings which are originated in the valve as a function of the instantaneous positions of the slider.

In very much the same way as outlined above, the slider 63 can be shifted towards the left so that the intake conduit 95 is placed in relationship of communication with the utilization conduit 94.

When the slider 63 is in the latter position, the fluid existing in the duct 74 flows out through the port 64, the bores 70, the hollow space 68, the valve 72, the bores 69 and reaches the chamber 67, to be discharged externally of the valve 60. The same is true of the fluid existing in the duct 94 which reaches the chamber 87 and is discharged externally of the valve 60 when the slider 63 is shifted towards the right. It is apparent that, when the slider 63 is in the inoperative position as in FIG. 1, the intake ducts 75 and 95 and the utilization ducts 74 and 94 are shuttered by the walls of the slider 63. The slider 63 has at either end a means, 96, for latching the corresponding end 42 of the stem 41 and, at the opposite end, a means 98 for latching the connecting rod of a manual actuator (not shown) of conventional make, which might be used, for example, in the case of malfunction of the electrical and hydraulic actuator. The manual actuator can easily be installed in lieu of the closing lid 99. The valve unit has gaskets 97 for providing a tight seal whereover required.

Obviously, modifications and changes can be introduced in the exemplary embodiment which has been described hereinabove, without departing from the scope of the present invention.

In the exemplary embodiment described in the foregoing, there are provided in the slider two hollow spaces 68 and 88 in the form of channels with the respective openings, but the possibility cannot be excluded of having a slider with more than two channel-shaped spaces with relative bores, the operation being akin to what has been disclosed hereinabove. It is possible simply to provide a slider with a single internal hollow space and relative bores: if so, the valve fulfils a mere regulation task.

The transducer is not compulsorily of the kind shown herein, but a transducer can be provided for any static or dynamic parameters of the stem 41, to which such a transducer can be variously connected by a linkage. Finally, it is possible, still without departing from the scope of the invention, to provide an electrical and hydraulic actuator which is less sophisticated than that disclosed for the above described exemplary embodiment, by dispensing with the transducer and the control station and by directly connecting the coilings 53 of the electromagnetic system with an electric signal generator external to the electrical and hydraulic actuating unit.

I claim:

1. An electrically and hydraulically actuated flow-distributing valve unit comprising an electrical-hydraulic actuator comprised of a body having an interior provided with a cylindrical seating which is adapted to receive a sliding piston which partitions the seating into two hydraulically separated chambers individually connected to intake and outlet ducts for a pressurized fluid, said intake ducts having fixed throttled passageways, said outlet ducts exhibiting throttled passageways of variable width, the degree of throttling being adjustable by virtue of electrically and magnetically actuated valve cores which restrict the flow and originate controlled pressure drops, said piston being extended at both ends into two stems, a flow-distributing valve integrally connected to said actuator, said valve having a slider gliding therein and connected to either stem of said actuator, said valve having ports adapted to be connected to fluid utilization, fluid discharge, fluid intake and pressure compensator ducts, said flow-distributing valve being composed by a valve body in the interior of which there is formed a cylindrical seat having said slider gliding therein, said cylindrical seat having formed therethrough flow-passageways for a pressurized fluid, the interior of said slider having at least an axial channel-shaped hollow space which communicates with a first bore radially passing through the slider and which, in alternate sequence consistently with the position of the slider, is either opened towards the port adapted for connection to the utilization ducts, or is opened towards the port adapted for connection to the fluid discharge ducts, or remains in the shuttered position against said cylindrical seat, a first set of bores spaced apart from said first bore and passing radially through the slider which are longitudinally arranged serially and which, in alternate sequence consistently with the position of the slider, are either opened towards the port adapted for connection to the fluid intake ducts, or towards the port adapted for connection to the fluid utilization ducts, or which remain in the position in which they are shuttered by said cylindrical seat, said set of bores having diameters which gradually increase in size in a direction toward said first bore, the area of the cross-sectional surface of said first bore being generally double the sum of the areas of the cross-sectional surfaces of said set of bores, at least another bore spaced apart from the previously named bores, the said another bore passing radially through the slider and which, in alternate sequence consistently with the slider position is either opened toward the port adapted for connection to the pressure compensator ducts or remains in the position in which it is shuttered by said cylindrical seat, nonreturn valve means being provided in said space for cutting off the fluid which comes from the port of the fluid intake duct, and latching means at the slider ends for latching to at least one of said two stems.

2. The valve unit as defined in claim 1 wherein said first set of bores have a circular outline and are arranged along a helical path.

3. The valve unit as defined in claim 1 including two axially channel-shaped hollow spaces formed in the interior of said slider.

4. The valve unit as defined in claim 1 wherein said nonreturn valve means is a slider valve means in said channel-shaped hollow space for selectively conducting fluid through said first bore towards the ports of the fluid utilization ducts in a first position and through said first bore toward the ports of the fluid discharge ducts in a second position.

5. The valve unit as defined in claim 1 wherein said nonreturn valve means is a slider valve means in said channel-shaped hollow space for selectively conducting fluid through said first bore towards the ports of the fluid utilization ducts in a first position and through said first bore toward the ports of the fluid discharge ducts in a second position, and said slider carrying further valve means for regulating the flow of fluid from an interior of said slider to said ports of said pressure compensation duct.

6. The valve unit as defined in claim 1 wherein said nonreturn valve means is a slider valve means in said channel-shaped hollow space for selectively conducting fluid through said first bore towards the ports of the fluid utilization ducts in a first position and through said first bore toward the ports of the fluid discharge ducts in a second position, said slider carrying further valve means for regulating the flow of fluid from an interior of said slider to said ports of said pressure compensation duct, and spring biasing means for normally urging said slider valve means to a position closing said first bore.

* * * * *